US008245895B2

(12) United States Patent
Kelly

(10) Patent No.: US 8,245,895 B2
(45) Date of Patent: Aug. 21, 2012

(54) LEADING EDGE RETAINING AND CUTTING DEVICE AND METHOD OF OPERATING SAME

(76) Inventor: Emily Anderson Kelly, Denver, CO (US)

( * ) Notice: Subject to any disclaimer, the term of this patent is extended or adjusted under 35 U.S.C. 154(b) by 719 days.

(21) Appl. No.: 12/346,674

(22) Filed: Dec. 30, 2008

(65) Prior Publication Data

US 2010/0162572 A1 Jul. 1, 2010

(51) Int. Cl.
*B26F 3/02* (2006.01)
*B26B 1/00* (2006.01)

(52) U.S. Cl. ..... 225/28; 30/2; 30/124; 30/278; 225/16

(58) Field of Classification Search ..... 30/2, 124, 30/278, 279.2; 225/28, 27, 16
See application file for complete search history.

(56) References Cited

U.S. PATENT DOCUMENTS

| | | | | | |
|---|---|---|---|---|---|
| 846,194 | A | | 3/1907 | Finan | |
| 1,980,573 | A | | 11/1934 | Cavanagh | |
| 2,120,960 | A | | 6/1938 | Arthur | |
| 2,339,144 | A | | 1/1944 | Bushnell | |
| 2,572,245 | A | | 10/1951 | Coldiron | |
| 2,734,576 | A | | 2/1956 | Slezak | |
| 3,186,892 | A | | 6/1965 | Walthers | |
| 3,230,620 | A | | 1/1966 | Embleton | |
| 3,323,208 | A | * | 6/1967 | Hurley, Jr | 606/120 |
| 3,684,141 | A | | 8/1972 | Hall | |
| 3,696,980 | A | | 10/1972 | Waltz | |
| 3,969,180 | A | | 7/1976 | Ravesloot | |
| 4,405,068 | A | | 9/1983 | Blair | |
| 4,711,031 | A | * | 12/1987 | Annello | 30/294 |
| 4,711,384 | A | | 12/1987 | Harris | |
| 5,014,431 | A | * | 5/1991 | Jebe et al. | 30/124 |
| 5,737,842 | A | | 4/1998 | Freedman | |
| 5,758,672 | A | * | 6/1998 | Chou | 132/275 |
| 6,105,217 | A | * | 8/2000 | Caradine et al. | 24/501 |
| 6,578,243 | B1 | * | 6/2003 | Hall | 24/501 |
| 6,658,742 | B2 | * | 12/2003 | Votolato | 30/280 |
| 6,877,230 | B2 | | 4/2005 | Tapia | |
| 7,073,264 | B2 | * | 7/2006 | Votolato | 30/294 |
| D566,511 | S | * | 4/2008 | Seehoff et al. | D8/98 |
| 2003/0116598 | A1 | * | 6/2003 | Huang | 225/56 |
| 2005/0211743 | A1 | * | 9/2005 | Mandar | 225/56 |

FOREIGN PATENT DOCUMENTS

| | | |
|---|---|---|
| GB | 2201946 | 9/1988 |
| GB | 2403941 | 1/2005 |

* cited by examiner

*Primary Examiner* — Sean Michalski
(74) *Attorney, Agent, or Firm* — The Reilly Intellectual Property Law Firm, P.C.; Ellen Reilly; John E. Reilly

(57) ABSTRACT

A retaining and cutting device for positioning a leading edge of material at one end of a roll and for puncturing and severing the material a pre-determined distance from the leading edge after removing from the roll, the retaining device comprising elongated jaw members pivotally connected together, a closure member normally urging the jaw members together, and a cutter along one edge of at least one of the jaw members. Extensions of the jaw members are manually grasped to urge the jaw members into an open position for insertion of the next leading edge of material therebetween. The device may also be utilized as a cutting tool for opening sealed boxes and the like.

5 Claims, 7 Drawing Sheets

LEADING EDGE RETAINING AND CUTTING DEVICE AND METHOD OF OPERATING SAME

The following relates to a novel and improved device and method for grasping and retaining a leading edge of a material; and more particularly relates to different embodiments of a device to be positioned along a leading edge of a roll of material for maintaining the leading edge from displacement as well as for cutting of the material.

BACKGROUND AND FIELD

Numerous types of holders and dispensers have been devised in the past which are adapted to be used with a roll of material such as adhesive tape. These holders/dispensers typically have multiple plastic and metal pieces including complicated dispensing members and cutting blades.

Notwithstanding the number of tape holders/dispensers which have been developed in the past, there is a continuing need for a leading edge retaining device that is easy to manufacture, simple to use and convenient to store. Moreover, there is a continuing need for such a device that is adaptable for use as a tape cutting tool as well.

SUMMARY

It is therefore desirable to provide for one or more embodiments of a novel and improved retaining device which will facilitate maintaining the separation of the leading edge of material from a remainder of material, preventing the leading edge of a roll of material, such as tape, from reattaching itself to said roll and which is readily conformable for use as a cutter, enabling the user to locate a desired length of material, cut off that length and retain the new leading edge of the material that is left after cutting. Further, the device is also adapted to cut segments of material such as tape, to allow opening of an article such as a box. It is also desirable to provide different embodiments of a tool having cutter variations and grip extensions that urge the member into an open position.

In one embodiment, there is provided a positioning device for holding and cutting material, having first and second elongated jaw members pivotally connected together including a member for releasably gripping an edge of the material therebetween, and a cutter along an edge of at least one of the jaw members. One of the jaw members may include a frictional or slightly adhesive-resistant surface portion engageable with a surface of the material. In other embodiments which incorporate the essential features of the one embodiment described, the cutter includes a projection having at least one cutting edge and scissor-like grasping members. Further, there is provided a method of retaining and cutting a leading end of material having a combination tool with pivotally connected first and second members forming a jaw, engaging members extending from the first and second members, and a cutting member positioned along one of the first and second members, the method comprising the steps of applying manual pressure to the engaging members urging the first and second members into an open position, positioning a leading edge of the material along an upper surface of the second member, and releasing the engaging members, thereby placing the first and second members into a closed position.

The above and other features of the embodiments described herein will become more readily appreciated and understood by considering the following detailed description of the embodiments when taken together with the accompanying drawings, in which:

DETAILED DESCRIPTION OF A FIRST EMBODIMENT

Figure 1:
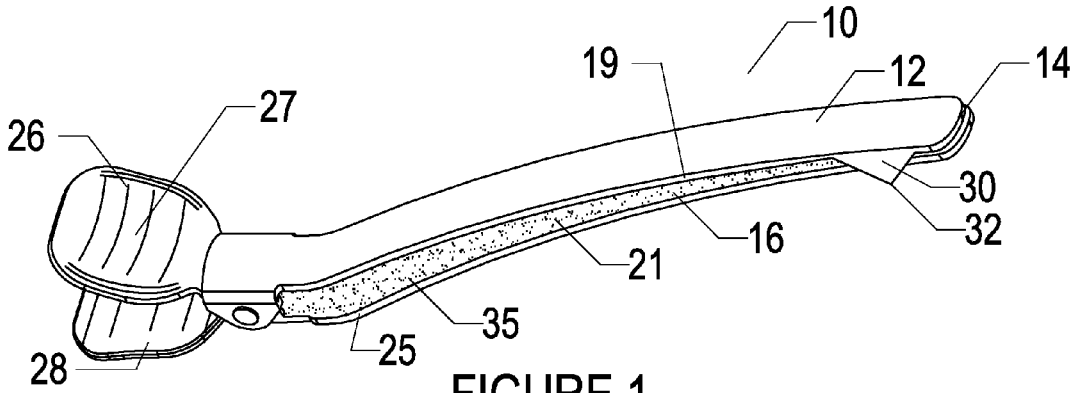
FIG. 1 is a perspective view of a first embodiment of a guard apparatus.
Figure 2:
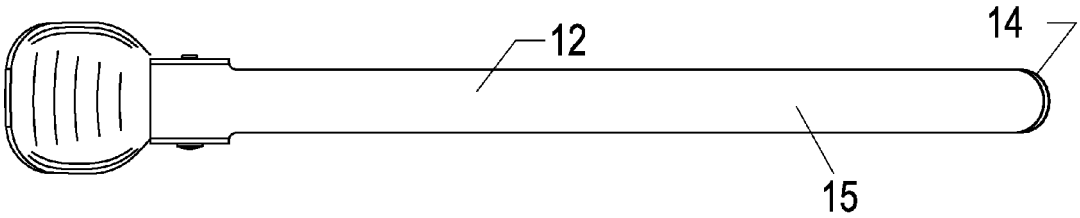
FIG. 2 is a top plan view of the embodiment shown in FIG. 1.
Figure 3:
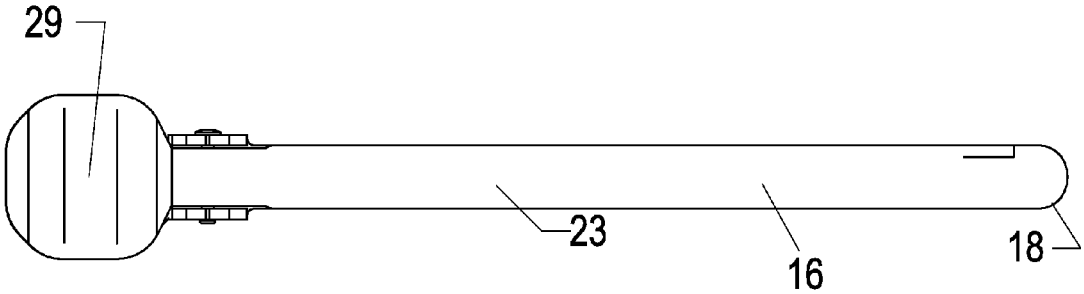
FIG. 3 is a bottom plan view of the embodiment shown in FIG. 1.
Figure 4:
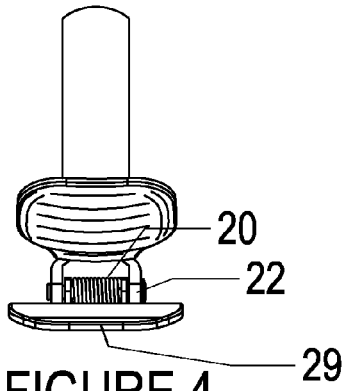
FIG. 4 is an end view of the embodiment shown in FIG. 1.
Figure 4A:
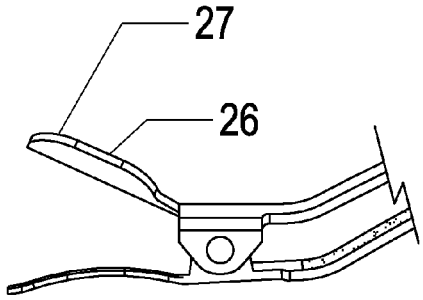
FIG. 4A is a side view of the embodiment shown in FIG. 4.
Figure 5:
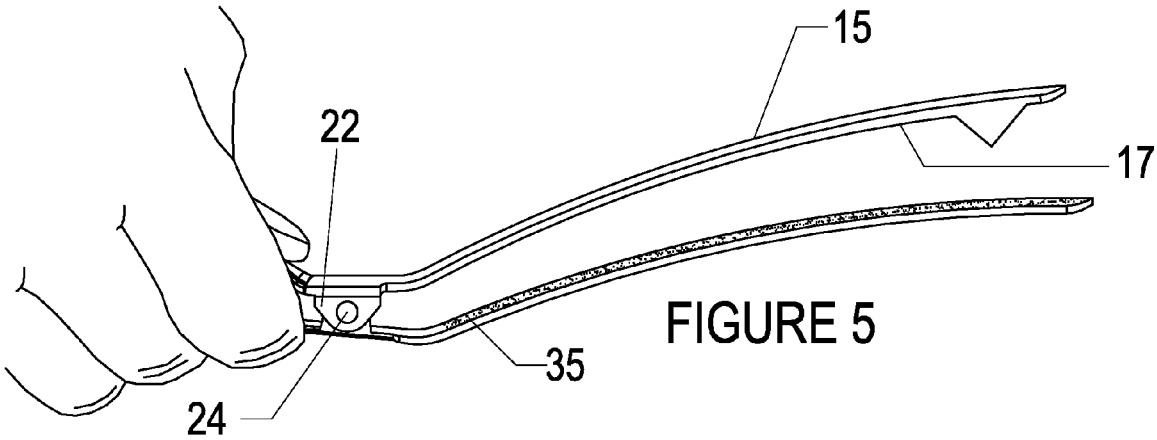
FIG. 5 is a side view of the embodiment shown in FIG. 1.

Referring in detail to the drawings, there is illustrated in FIGS. 1 through 5, a first embodiment of a tool 10 broadly comprising dual, cooperating elongated jaw or arm members 12, 16 pivotally connected together at one end of the arm members and extensions or clamping members 26, 28 of the arm members extending from a spring closure member 20 in a direction away from and at acute angles to the arm members. The first arm member 12 may be slightly curved with rounded end 14, upper and lower surfaces 15 and 17 respectively, and side edge 19. The second arm member 16 has a rounded end 18 and upper and lower surfaces 21 and 23, respectively, as well as side edge 25. The rounded ends 14 and 18 may also be tapered as well. The second arm member 16 has a concavo/convex surface and, when curved, has a complementary curve to the first member 12. The concavo/convex surfaces may facilitate positioning of the device on a roll R but linear, flat surfaces may also be used. The first and second arm members may have a length corresponding to the width of the material used, although in some cases this may not be practical. For example and not by limitation, the embodiment shown has the first and second arm members 12 and 16 with a length at least as wide as the width of a standard roll of packing tape. The first and second elongated arm members 12, 16, traverse the width of the material for lengthwise advancement of the material between the arm members and include the dual opposing side edges 19 and 25 in facing relation to one another along their length. The first arm member 12 and the second arm member 16 are connected with the spring member 20, as shown in FIGS. 4 and 4A, that is preferably a spring loaded hinge encased within an outer shell 22 and secured with a pin member 24. Other forms of connection members, such as hinge members, biasing members or any type of device that forces the arm members together, may be used without departing from the scope of the tool 10. Opposite the ends 14 and 18 are the extensions or clamping members 26, 28 which may be manually grasped to urge the first and second arm members, 12 and 16, into an open position as shown in FIG. 5. The clamping members 26, 28 are preferably slightly rounded with waffled, scored or rubber coated surfaces to facilitate gripping of the clamping members. The first clamping member 26 extends slightly upwardly and is adapted to urge the first arm member 12 into an open position when pressure is applied to the first clamping member 26. The first clamping member 26 may include a thumb engaging member having a ridged surface and a slight depression 27 may also be present to facilitate use of the first clamping member 26. The slight depression 27 may be of concave configuration to complement the convex shape of a user's thumb. The second clamping member 28 extends outwardly along a horizontal plane and may have a slight depression 29, as shown in FIGS. 3 and 4, extending in a plane perpendicular to the first and second arm members to complement placement of a user's index finger. The clamping members are positioned adjacent to one end of the elongated arm members. The combination of the spring member 20 and the first and second arm members 12, 16 forms a jaw or clip capable of opening and closing. Application of pressure to the first clamping member 26 while also applying steady pressure to the second clamping member 28 urges the first and second arm members 12, 16 apart and allows for placement of material, such as the leading edge L of a roll of adhesive tape R, between the first and second arm members thereby grasping and retaining the leading edge L.

Figure 6:
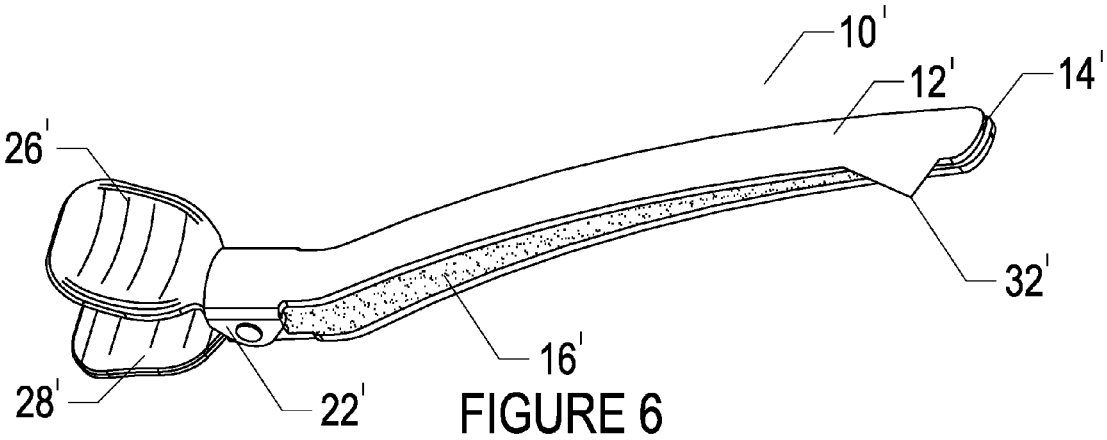
FIG. 6 is a side perspective view of an alternate form of the embodiment shown in FIG. 1.
Figure 7:
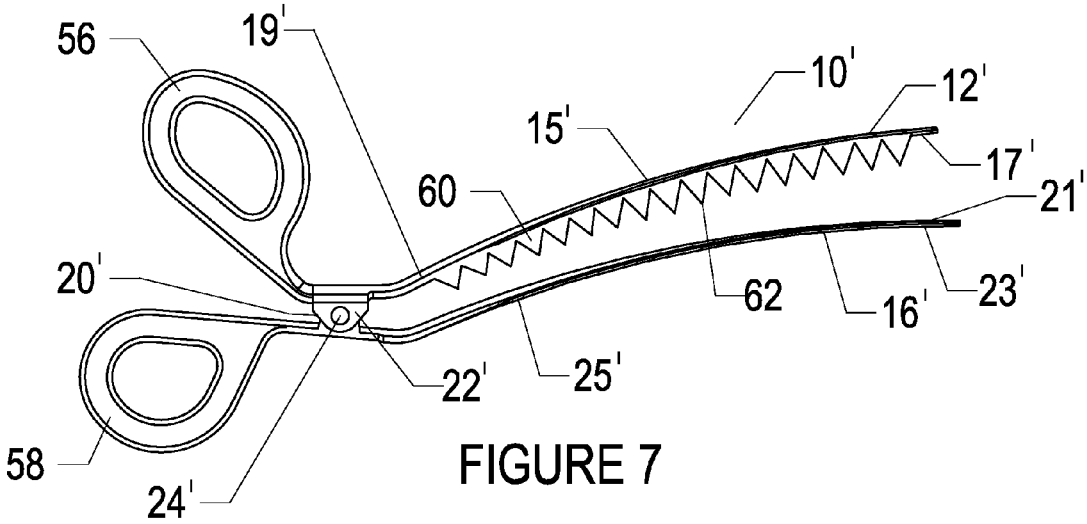
FIG. 7 is an alternate form of the embodiment shown in FIG. 1.
Figure 10:
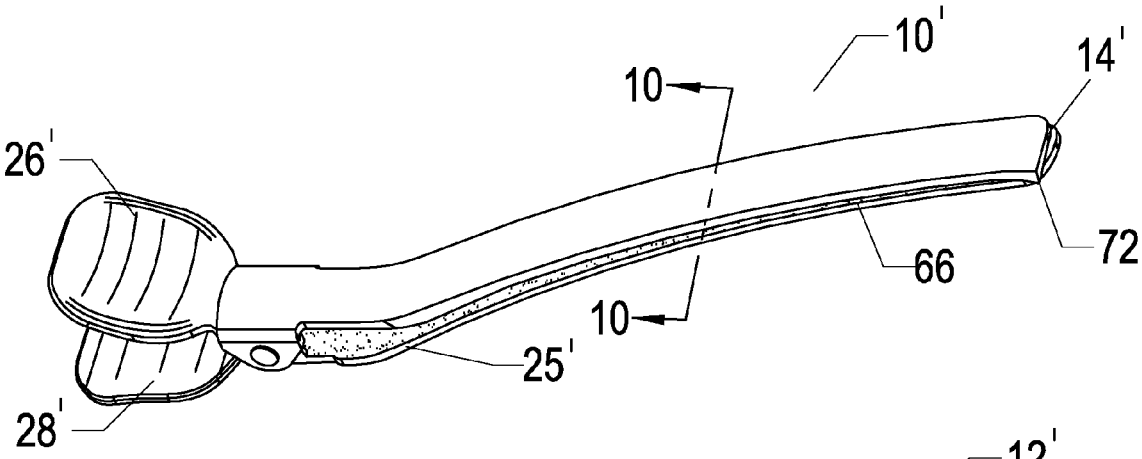
FIG. 10 is an alternate form of the embodiment shown in FIG. 1.

As illustrated, the upper member 12 includes a cutter 30 having at least one cutting edge 32. The cutter 30 is triangular or semi-triangular in shape and relatively sharp, allowing for cutting of threads contained within the material, such as in duct and some packing tapes, and allows the cutting edge 32 to be urged through the material, piercing the surface and commencing the cutting process. The cutter 30 may be mounted along the exterior edge 19 of the first arm member 12, in close proximity to the rounded end 14, but may be mounted along an interior edge of the first or second arm member 12, 16 or the cutter may extend horizontally along all or a partial portion of the first or second arm member as shown in FIGS. 6, 7 and 10. A substantial length of the upper surface 21 of second arm member 16 may include a frictional or semi-adhesive surface 35 which is adapted to engage the tacky or sticky side of the adhesive tape R. The frictional surface portion is designed to provide an appropriate or desired degree of adhesion between the tacky or adhesive surface of the material and the frictional surface portion. Specifically, the degree of adhesion should be sufficient to maintain control of the material but not so great that the material cannot be easily disengaged from the device as required. The frictional surface 35 also provides a surface capable of retaining material such as plastic, cloth and the like, that may not have an adhesive surface, within the arm members 12 and 16. The addition of the frictional surface 35 may be accomplished by applying any type of sufficiently strong adhesive or a non-slip, gripping material to a desired surface or by scoring the desired surface with a sharp object to form an uneven surface.

The tool is in the shape of a modified "V" in the open position, the clamping members and hinge forming the joining portion of the "V" shape, as shown in FIG. 5. The first and second arm members 12, 16 are elongated with non-tapered ends but may also have tapered ends. The above described tool may be manufactured of stainless steel or similar types of metal but may also be made of a number of other substances such as plastic, rubber or wood, or a combination thereof, without departing from the scope of the device.

Figure 11:
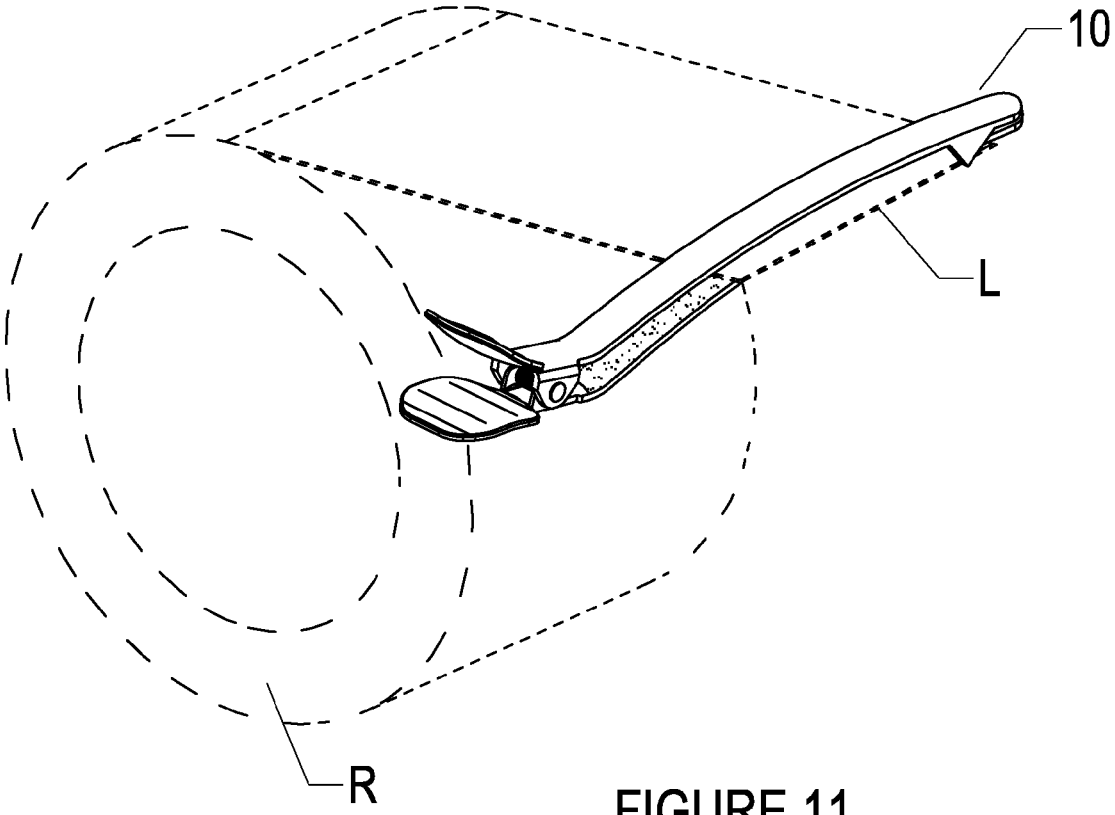
FIG. 11 is a view demonstrating the device in use.
Figure 12:
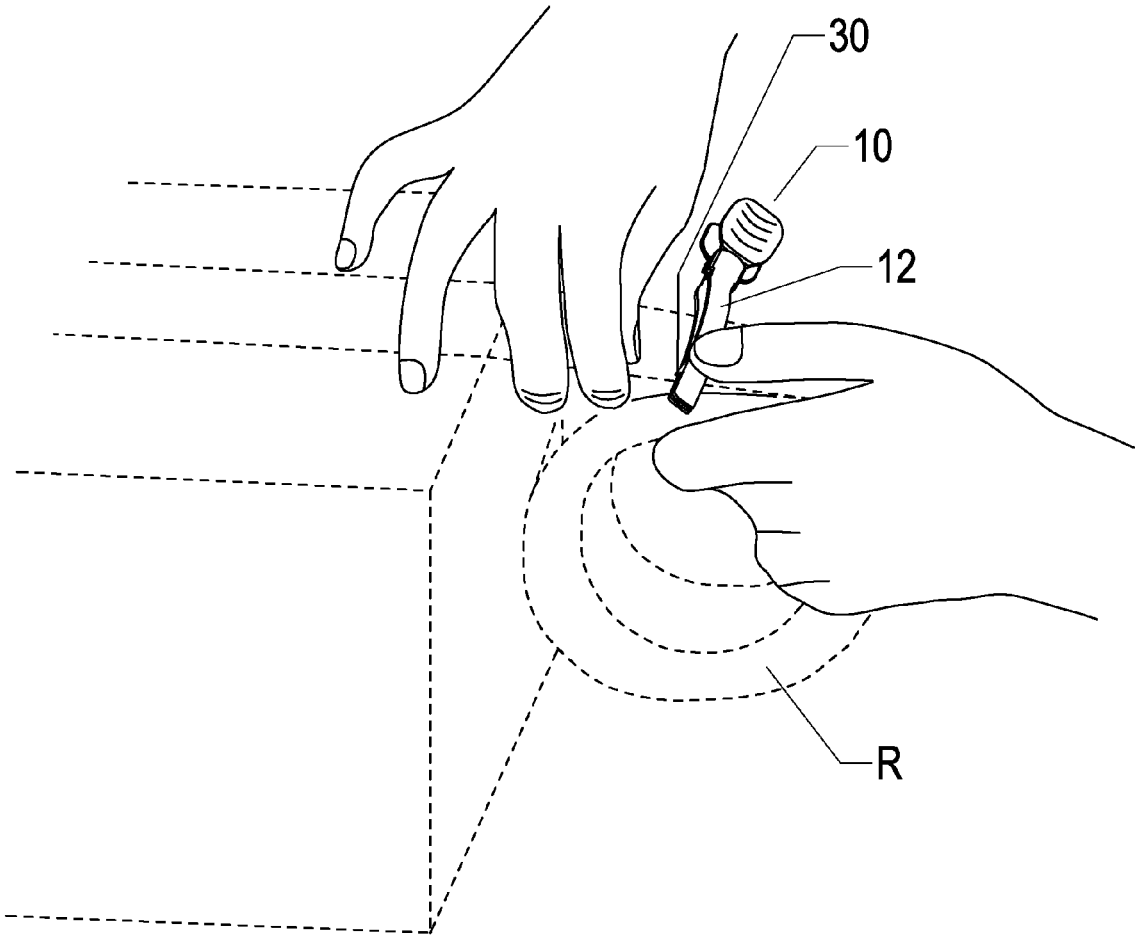
FIG. 12 is a view demonstrating the device in use.

In use, offered by way of example and not limitation, the leading edge L is manually separated from the tape roll T. While manually holding the edge L, pressure is applied to the first and second clamping members 26, 28 to facilitate opening or separation of the first and second arm members 12, 16. The material or tape edge L, having a lower tacky surface is placed along a length of the frictional surface 35 on the second arm member 16 of the tool 10. Releasing pressure on the first and second clamping members 26, 28 allows the first and second arm members 12, 16 to close, thereby retaining the leading edge L in place and preventing displacement as shown in FIG. 11. The device 10 and tape roll R may be stored in this manner, preventing the tape edge L from re-adhering to the tape roll and protecting it for future use. If a tape segment is desired to be cut, the leading edge L may be manually grasped and pressure is applied to the first and second clamping members simultaneously. This allows the arm members to open allowing for removal of the leading edge L from the device. Once a proper or desired amount of tape is separated from the roll R, the device is then re-positioned with both arm members grasping the tape in close proximity to the roll R as shown in FIG. 12 and, while applying pressure to the upper surface of the first arm member 12, the cutter 30 pierces or punctures the tape. Once the tape is punctured, the leading edge may be manually grasped and pulled away from the tape while maintaining a grip on the punctured portion of the tape as shown in FIG. 12. This action allows for initiation of the severing of the tape segment from the tape roll R. Once the tape segment is cut, the tool 10 may be left in position on what is now the leading edge L of the tape and stored for later use.

Figure 13:
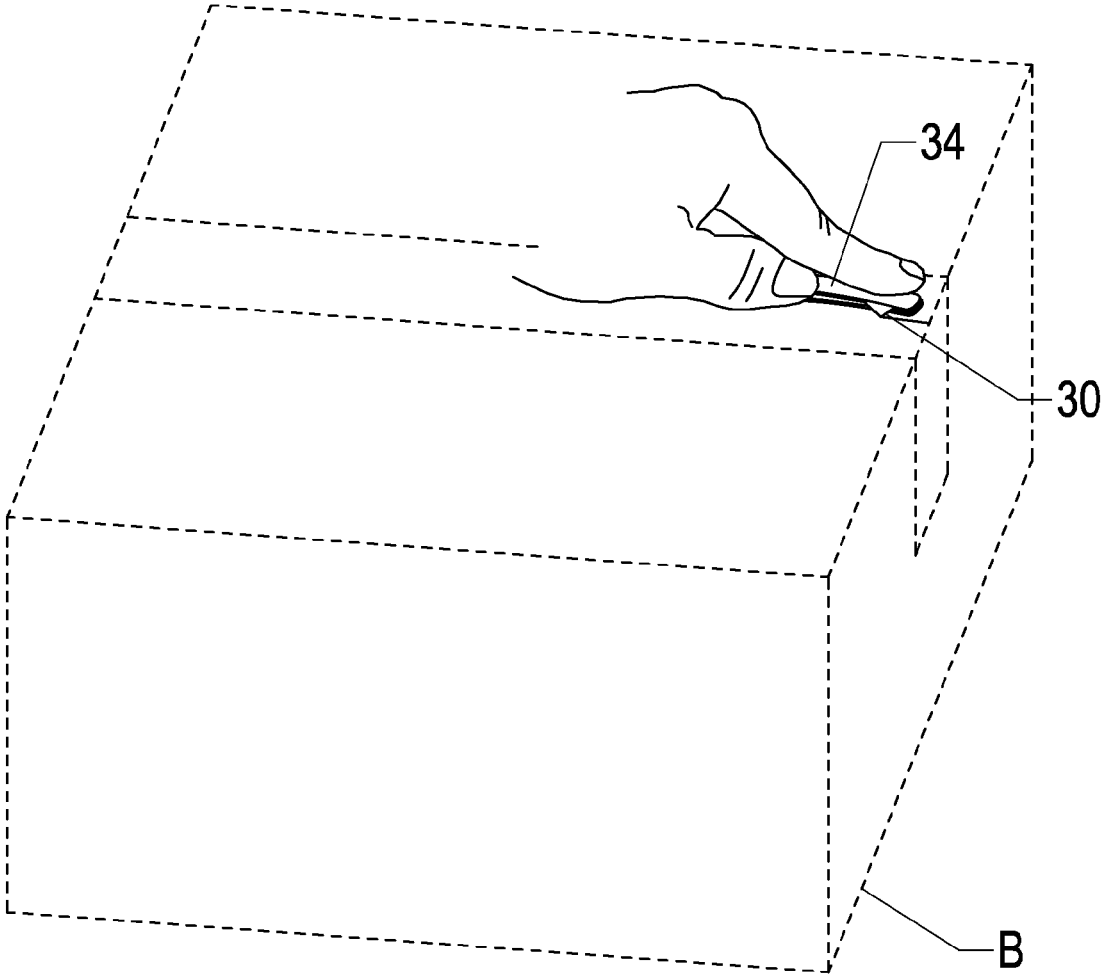
FIG. 13 is a view demonstrating an additional use of the apparatus.

The device 10 may also be used to cut material such as tape on a sealed container B and the like. The device 10 is oriented in a closed position and placed along a surface of a length of tape as shown in FIG. 13, with the cutter 30 projecting downwardly. Pressure is then applied manually along the top surface 15 of the device 10, in close proximity to the location of the cutter 30. The cutter 30 will then puncture the tape surface where desired. The device may then be directed along a desired path to achieve cutting of the tape and opening of a box, for example. As set forth previously, the device 10 may be used for adhesive tape but also may be used on any other type of material or substance where the material is desired to be cut or the leading edge of said material is desired to be protected against displacement.

DETAILED DESCRIPTION OF ALTERNATE EMBODIMENTS

FIGS. 6, 7, 8, 9, 10 and 10A illustrate alternate forms of the device which utilize the first and second jaw members as well as the hinge member of the first embodiment in combination with varied cutting surfaces and grasping members. Accordingly, like elements are correspondingly enumerated with prime symbols. Thus, the device once again comprises a tool 10' having dual, cooperating elongated arm members 12' and 16', a hinge member 20' connecting the dual arm members and cooperative first and second extension members 26', 28'. The first jaw member 12' may be slightly curved and has upper and lower surfaces 15' and 17' respectively, and side edge 19'. The second jaw member 16' has upper and lower surfaces 21' and 23', respectively, as well as side edge 25'. The second jaw member 16' preferably has a complementary curve to the first member 12' as previously described. The first jaw member 12' and the second jaw member 16' are connected with the hinge member 20' that is preferably a spring loaded hinge encased within an outer shell 22' and secured with a pin member 24'. One form of cutter is shown in FIG. 6 wherein the cutting edge 32' may extend outwardly along a horizontal plane from the first or second jaw member or may extend at any angle from 0° to 90° to the plane created by one of the jaw members. FIG. 7 shows a scissor member opposite rounded ends 14', 18' which is defined by complementary handle members 56 and 58, respectively, corresponding to the first and second members 12' and 16'. The combination of the hinge member 20' and the first and second members 12', 16' form a jaw capable of opening and closing. Application of pressure to the handle members 56 and 58 forces the first and second members apart and allows for placement of articles, such as the leading edge L of a roll of adhesive tape R, between the first and second jaw members.

Figure 8:
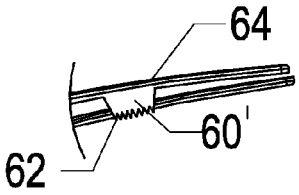
FIG. 8 is an alternate form of the embodiment shown in FIG. 1.
Figure 9:
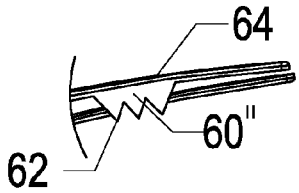
FIG. 9 is another form of the embodiment shown in FIG. 1.
Figure 10A:
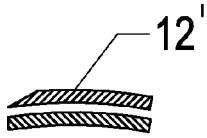
FIG. 10A is a cross-section about lines 10-10 of the embodiment shown in FIG. 10.

As illustrated in FIGS. 7, 8 and 9, the first jaw member 12' includes a variety of cutting members 60, 60', and 60" by way of example and not limitation, having at least two cutting edges 62 located along a distal exterior edge 64 of the tool 10'. The cutting members are preferably triangular in shape but may form any other shape as long as a cutting edge is present. The cutting member 60 may also be mounted along a portion of the first or second jaw members 12', 16' as shown in FIG. 7 and may be utilized on various types of material including tape reinforced with thread as described previously. The cutting member may also include a single blade, serrated edges or multiple blades located along first and second jaw members. A further embodiment of a cutter is shown in FIGS. 10 and 10A wherein a continuous beveled edge 66 extends along an exterior edge of a jaw member, preferably the first jaw member 12', creating a 'scissor edge' to facilitate cutting of the material. The cutting edge 66 may extend slightly beyond the end 14' forming a right angle edge 72 for use as a puncturing tool for cutting a length of material and as an additional cutter for opening taped boxes and the like. A removable protective cover (not shown) may also be added to the cutting member to prevent injury from the cutting member.

Although a number of characteristics and advantages have been discussed above, those of ordinary skill in the art will recognize other modifications, permutations, additions, and sub-combinations thereof. It is therefore intended that the following appended claims and any claims hereafter introduced should be interpreted to include all such modifications, permutations, additions, and sub-combinations as are within their true spirit and scope.

I claim:

1. A combination of a material clamp, a roll of material and a cutter for cutting said material, comprising:

first and second narrow elongated arm members having opposing respective gripping inner surfaces, a first of said inner surfaces being convex and a second of said inner surfaces being concave in complement to the first inner surface, and said arm members being joined together at a pivot;

said inner surfaces urged by a spring towards one another into a closed position making contact with one another and the leading edge of material extending from said roll of material; and said arm members being integral with respective first and second manual grasping elements, provided for urging said arm members about said pivot into an open position wherein said inner surfaces are not in contact with one another; and a cutter having at least one cutting edge integrally extending from and perpendicular to one of the opposing surfaces of the arm members.

2. The combination according to claim 1 wherein said gripping inner surfaces are defined by a frictional surface portion engageable with a surface of said material.

3. The combination according to claim 1 wherein a said cutter is positioned at a distal end of at least one of said elongated arm members.

4. In said combination according to claim 1 wherein said first and second clamping members include looped grasping members.

5. In a combination tool according to claim 1 wherein said first and second arm members terminate in rounded ends.

* * * * *